US010327527B1

(12) United States Patent
Tyson

(10) Patent No.: US 10,327,527 B1
(45) Date of Patent: Jun. 25, 2019

(54) PERFECT BAG PLUS

(71) Applicant: Joshua Tyson, New York, NY (US)

(72) Inventor: Joshua Tyson, New York, NY (US)

( * ) Notice: Subject to any disclaimer, the term of this patent is extended or adjusted under 35 U.S.C. 154(b) by 2 days.

(21) Appl. No.: 15/530,761

(22) Filed: Feb. 24, 2017

(51) Int. Cl.

| | |
|---|---|
| ***A45C 15/04*** | (2006.01) |
| ***A45C 15/06*** | (2006.01) |
| ***A45C 13/00*** | (2006.01) |
| ***A45C 13/10*** | (2006.01) |
| ***A45C 3/06*** | (2006.01) |
| ***A45C 11/00*** | (2006.01) |
| ***A45C 13/26*** | (2006.01) |
| ***A45D 42/10*** | (2006.01) |
| ***A45D 42/04*** | (2006.01) |
| ***A45D 40/24*** | (2006.01) |
| ***F21V 21/096*** | (2006.01) |
| ***F21V 23/04*** | (2006.01) |
| ***F21L 4/08*** | (2006.01) |

(52) U.S. Cl.
CPC ..... *A45C 15/06* (2013.01); *A45C 3/06* (2013.01); *A45C 11/008* (2013.01); *A45C 13/001* (2013.01); *A45C 13/103* (2013.01); *A45C 13/26* (2013.01); *A45C 15/04* (2013.01); *A45D 40/24* (2013.01); *A45D 42/04* (2013.01); *A45D 42/10* (2013.01); *F21L 4/08* (2013.01); *F21V 21/0965* (2013.01); *F21V 23/0414* (2013.01)

(58) Field of Classification Search
CPC ..... A45C 15/06; A45C 11/008; A45C 3/06; A45C 13/103; A45C 13/001; A45C 15/04; A45C 13/26; F21L 4/08; F21V 21/0965; F21V 23/0414; A45D 40/24; A45D 42/04; A45D 42/10
See application file for complete search history.

(56) References Cited

U.S. PATENT DOCUMENTS

| | | | | |
|---|---|---|---|---|
| 5,911,262 | A * | 6/1999 | Steinhart | A45C 13/02 150/103 |
| 6,502,951 | B2 * | 1/2003 | Marshall | A45C 13/02 362/154 |
| 2002/0067610 | A1 * | 6/2002 | Marshall | A45C 13/02 362/156 |
| 2004/0141314 | A1 * | 7/2004 | Vautrin | A45C 15/06 362/156 |
| 2010/0053941 | A1 * | 3/2010 | Ibison | A45C 13/24 362/155 |
| 2011/0061675 | A1 * | 3/2011 | McKinley | A45D 33/20 132/296 |

(Continued)

FOREIGN PATENT DOCUMENTS

| | | | | |
|---|---|---|---|---|
| GB | 2460425 | A * | 12/2009 | A45C 13/02 |
| GB | 2536665 | A * | 9/2016 | A45C 15/06 |

*Primary Examiner* — Charlie Y Peng
(74) *Attorney, Agent, or Firm* — Michael D. Eisenberg

(57) ABSTRACT

The invention of the Perfect Bag Plus evolved from a void in the beauty and fashion industries. The Perfect Bag Plus is the fusion of a common accessory, a handbag enclosed with the contents of makeup, cosmetic applicators and a detachable lighted mirror all in one. It creates the perfect portable vanity by providing a detachable lighted mirror that when illuminated with led lights, it produces optimum visibility for clear, accurate and even application or removal of makeup. The Perfect Bag Plus can be made in multiple various handbag styles and is easy to maintain.

2 Claims, 18 Drawing Sheets

(56) References Cited

U.S. PATENT DOCUMENTS

| | | | | |
|---|---|---|---|---|
| 2012/0241482 | A1* | 9/2012 | Mabika | A45C 3/06<br>224/148.4 |
| 2016/0183654 | A1* | 6/2016 | Leuty | A45C 3/02<br>362/155 |
| 2016/0198819 | A1* | 7/2016 | Grund | A45C 5/005<br>132/288 |
| 2016/0363806 | A1* | 12/2016 | Sinderbrand | G02F 1/133308 |

* cited by examiner

PERFECT BAG PLUS

BACKGROUND OF THE INVENTION

The present invention, in some embodiments of the present invention, relates to bags, such as handbags, satchels, and clutch bags, for example.

People applying or removing makeup in public generally store their makeup and mirrors in handbags and have to open their handbags in order to reach for the makeup and mirror. This can be quite uncomfortable, as the handbag generally contains other objects, such as phones, purses, wallets, diaries, pens, etc.

The present invention offers a solution to this problem.

BRIEF SUMMARY OF INVENTION

The Perfect Bag Plus is every women dream handbag. It was conceived by observing ladies over the years apply and remove makeup in public. The Perfect Bag Plus fills a void in the everyday function of and use of ladies handbags and cosmetics. The innovation of this invention fuses three components together creating the Perfect Bag Plus. The three components that comprise the Perfect Bag Plus are a handbag, a detachable lighted mirror and makeup with cosmetic applicators. The Perfect Bag Plus has a lighted mirror attached to the body of the lining in the upper compartment and makeup and cosmetic applicators enclosed in the lower compartment. The Perfect Bag Plus can be utilized as a carry all handbag with a lighted mirror, makeup and cosmetic applicators creating a portable travel vanity.

The lighted mirror is attached to the body lining wall with magnetic snaps that allow detachment for multiple use. When the lighted mirror is detached it can be utilized as a flashlight, a hand held lighted mirror or attached to another magnetic alloy to create an independent lighting source.

The Perfect Bag Plus maximizes the use of the most common ladies fashion accessory, the handbag. It is an improvement upon prior art by incorporating a detachable lighted mirror, makeup and cosmetic applicators all in one handbag. The lighted mirror is attached to the lining with magnetic snaps that allows the flexibility of detachment. The lighted mirror has an adjustable handle on the back that can rotate to a vertical position allowing the user the option of having a hand held lighted mirror when detached. Another improvement of the Perfect Bag Plus is that it provides the user with the convenience of carrying a purse that acts as a portable vanity that has a compartment enclosed with makeup, cosmetic applicators and a detachable lighted mirror. The lighted mirror can be attached to another magnetic alloy for optional use.

In summary the Perfect Bag Plus was developed from the most common need of women carrying a handbag with makeup, cosmetic applicators and a mirror all contents of the handbag. The invention of the Perfect Bag Plus is the results of combining a handbag, makeup, cosmetic applicators and a detachable lighted mirror. The Perfect bag Plus provides all the necessary needs for refreshing, applying or removing makeup in any light or dark environment. The detachable lighted mirror serves multiple functions, it can be utilized as a flashlight, a hand held lighted mirror or an independent lighting source. When activated the lighted mirror is illuminated with led lights that provide optimum visibility. The Perfect Bag Plus comes fully equipped with makeup and cosmetic applicators. This invention, the Perfect Bag Plus allows the mobility for travel with makeup, cosmetic applicators and a detachable lighted mirror all comprised in an alluring carry all handbag. The fusing of a handbag enclosed with makeup, cosmetic applicators and a controlled detachable lighted mirror makes the Perfect Bag Plus desirable, marketable and an improvement upon any prior art.

DETAILED DESCRIPTION OF THE INVENTION

Figure 16:
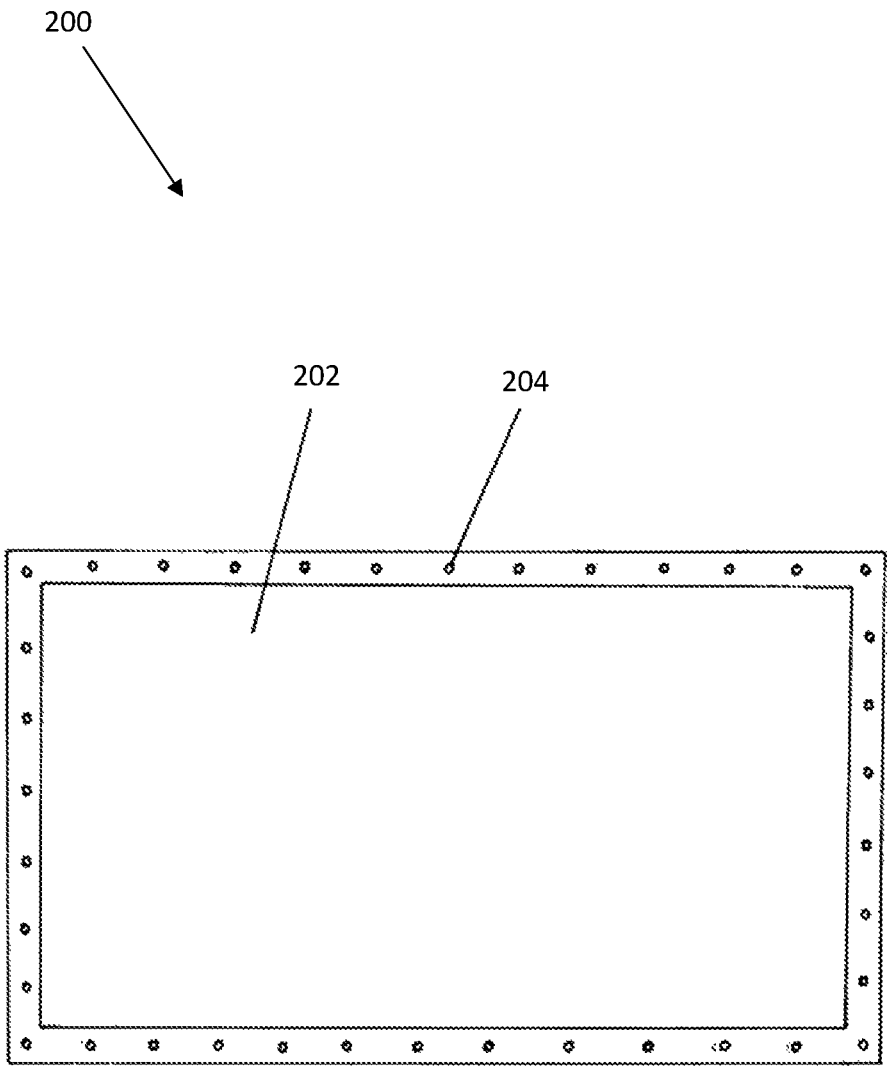
FIG. 16 drawing shows the front view of a detached lighted mirror device from the Perfect Bag Plus. In this drawing the rectangular shaped mirror 2 is centered with led lights 1 surrounding it.

The Perfect Bag Plus is every girl's dream bag. It is fashionable, alluring and a multi-functional handbag 100. The innovative feature about the Perfect Bag Plus is that it has a detachable lighted mirror device 200, see FIGS. 14 and 16. This lighted mirror device has a rectangular shaped mirror 202 surrounded with led lights 204, see FIGS. 16 and 18. The Perfect Bag Plus acts as a portable vanity that features a lighted mirror in the upper compartment 102, see FIGS. 1, 6, 8, and 12. Makeup and cosmetic applicators are enclosed in a zipper/lower compartment 104 or a zip pocket located in the front, side or back of the handbag. When the zipper/lower compartment 104 is zipped open, the lighted mirror device 200, makeup and cosmetic applicators are revealed and accessible, see FIGS. 1, 6, 8 and 12. The lighted mirror device 200 is attached to the lining of the body of the upper compartment 102 of the handbag (see FIGS. 1, 6, 8 and 12). Makeup and cosmetic applicators are enclosed in the lining of the upper compartment 102 and/or lower compartment 104 in FIGS. 1, 6, 8 and 12. The lighted mirror device 200 is attached to the lining with magnetic snaps 206 that securely holds it in place while allowing easy detachment when desired. There are two magnetic snaps hidden under the body lining and two magnetic snaps attached to the back of the lighted mirror device, see FIGS. 13 and 17. When the lighted mirror device 200 is attached to the handbag 100, it functions as a lighted mirror and when the lighted mirror device is detached, it can be utilized as a flashlight, a hand held lighted mirror, or an independent lighting source. Once the lighted mirror device 200 is detached it can be attached to any magnetic alloy, giving the user the option of having a lighted mirror or an independent lighting source. The lighted mirror device 200 has an adjustable handle 208 on the back (see FIGS. 13 and 17) that provides the convenience and comfort of having a hand held lighted mirror. FIGS. 2, 4, 7 and 11 are all drawings of the Perfect Bag Plus handbags 100 zipped closed. The Perfect Bag Plus is an improvement upon prior art by comprising a controlled lighted mirror that is detachable with multi-functions, inexpensive and easy to maintain. The Perfect Bag Plus can be designed in a multitude of handbag styles ranging from totes, satchels, clutches, cross body bags, messenger bags, barrel bags, and backpacks all having in common a lighted mirror device, makeup and cosmetic applicators in separate compartments. See FIGS. 1, 6, 8 and 12 for examples of zipped open Perfect Bag Plus totes, satchels and clutch bags with lighted mirrors devices, makeup and cosmetic applicators shown in drawings.

The Perfect Bag Plus can be made in fabric, leather or synthetic leathers. The next prominent feature about the Perfect Bag Plus is the cosmetic compartment enclosed in the lining in the lining of the flap, accessible when zipped open, see FIGS. 1, 6, 8 and 12. This cosmetic compartment has the capacity to hold mascara, lipstick, lip gloss, eye shadow, eye liner, blush, foundation and cosmetic applicators. The Perfect Bag Plus cosmetic compartment is fully equipped with all the essential cosmetics products and applicators necessary for a touch up or makeover while on the go. When utilizing the Perfect Bag Plus, makeup can be applied or removed in cars, on trains, airplanes or in any light or dark environment.

Figure 1:
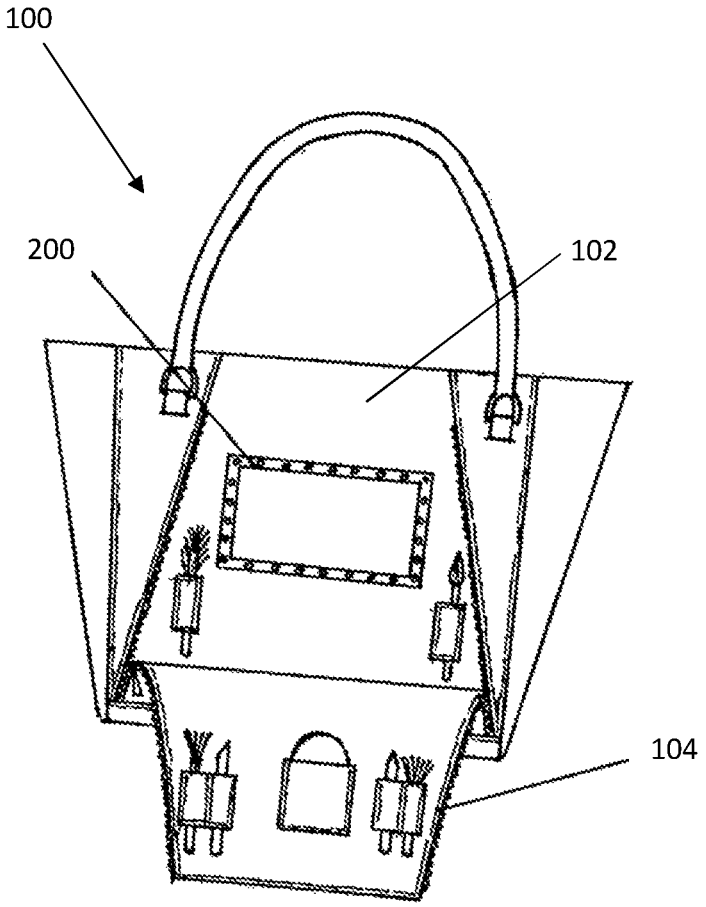
FIG. 1 illustration shows front view of the Perfect Bag Plus tote bag zipped open revealing a rectangular shaped lighted mirror device attached to the lining wall of the handbag with makeup applicators on the right and left side. Also shown in this drawing is the lower compartment flap enclosed with makeup and cosmetic applicators.
Figure 2:
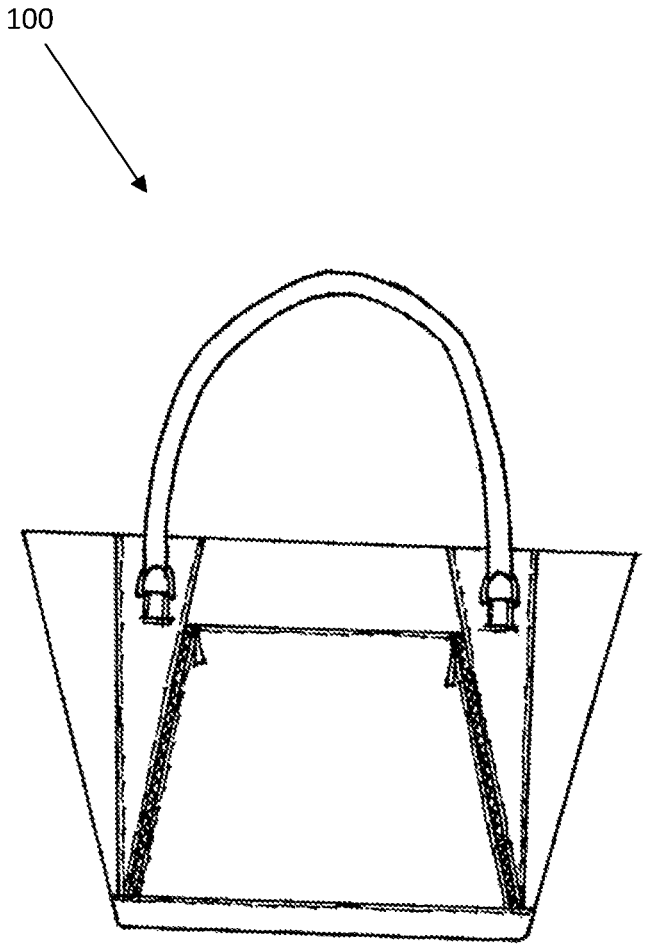
FIG. 2 Drawing shows front view of the Perfect Bag Plus front pocket zipped closed concealing the lighted mirror device, makeup and cosmetic applicators.
Figure 3:
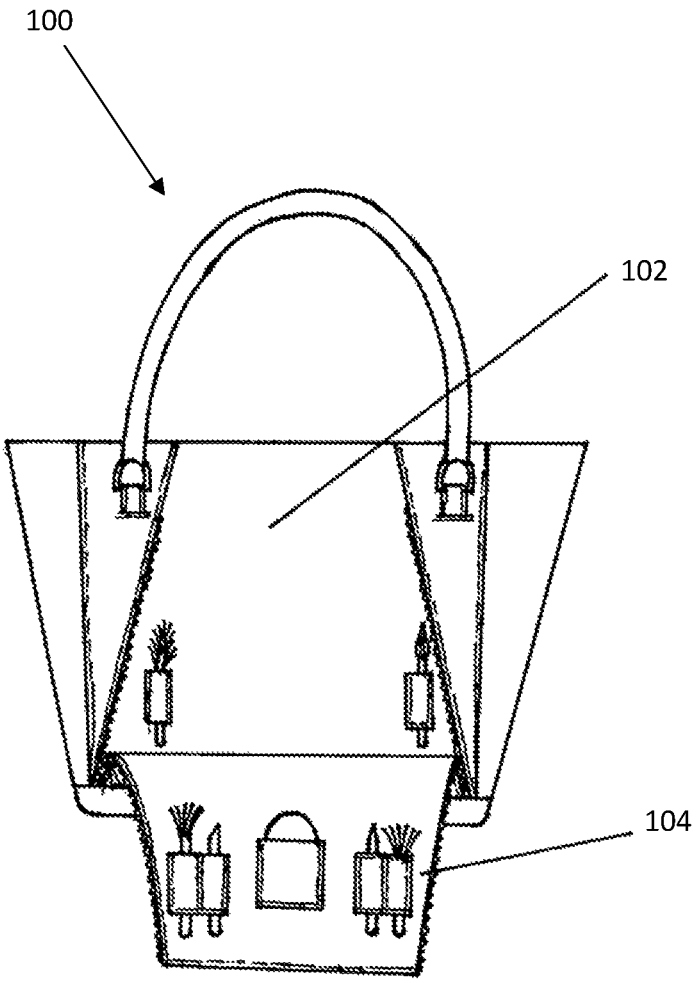
FIG. 3 This illustration shows the front view of a Perfect Bag Plus zipped open with lighted mirror device removed from the upper compartment of the handbag. This drawing also shows makeup and cosmetic applicators enclosed in the lower compartment flap.
Figure 4:
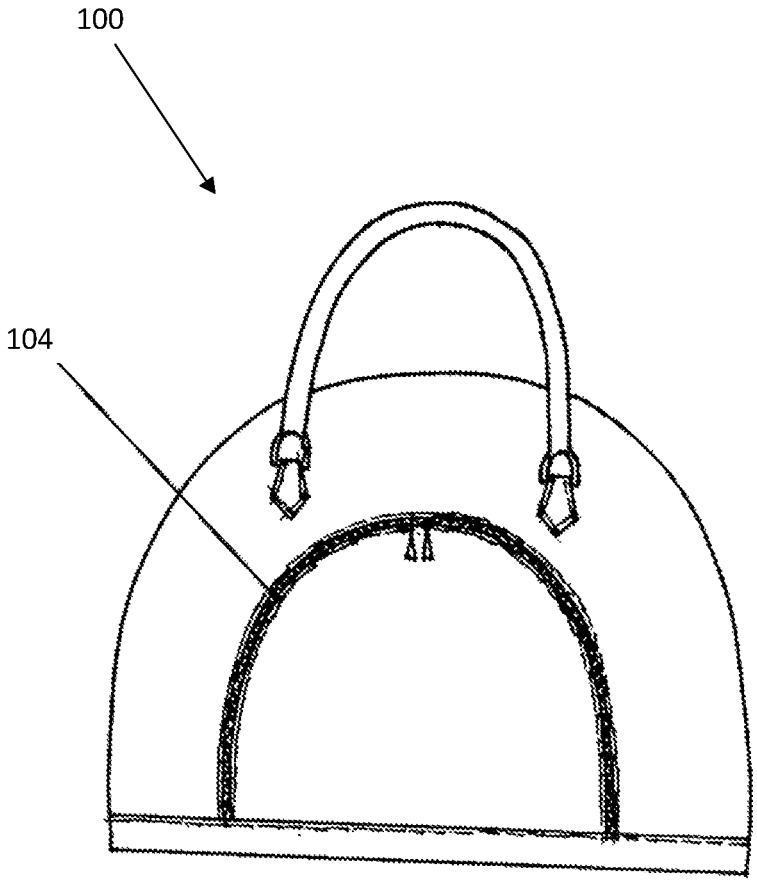
FIG. 4 This drawing shows the front view of a satchel style Perfect Bag Plus with the front pocket zipped closed.
Figure 5:
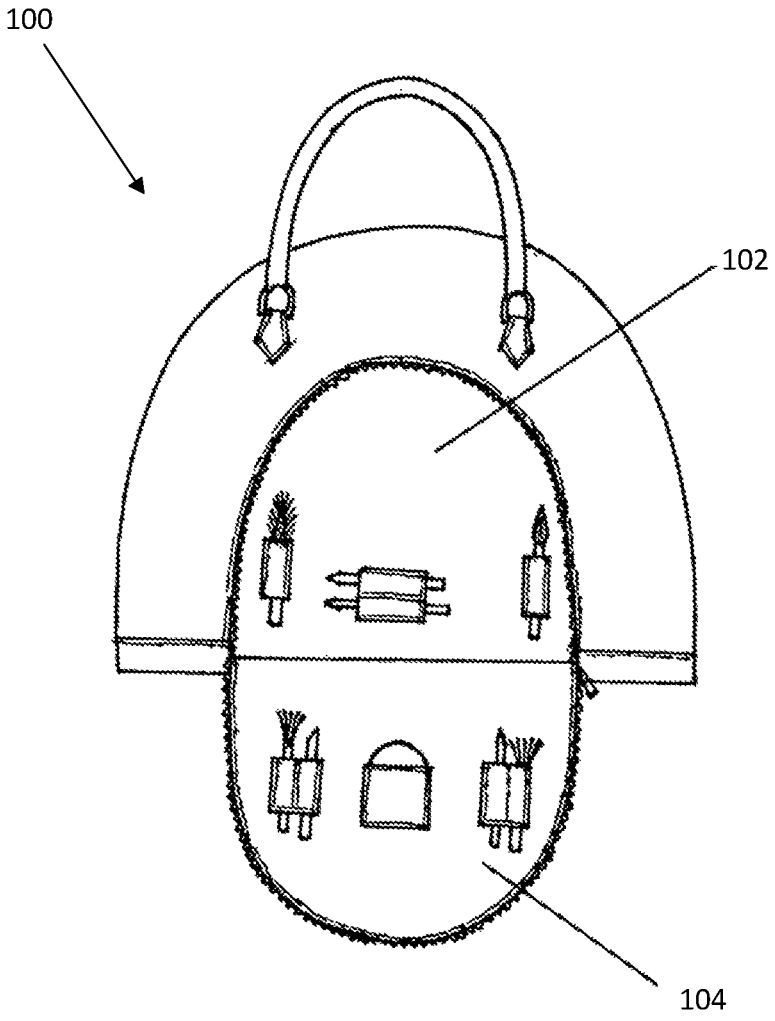
FIG. 5 Shows front view of the Perfect Bag Plus satchel zipped open with the lighted mirror device detached from the from the lining. This drawing also shows the lining of the pocket flap referred to as the lower compartment enclosed with makeup and cosmetic applicators.
Figure 6:
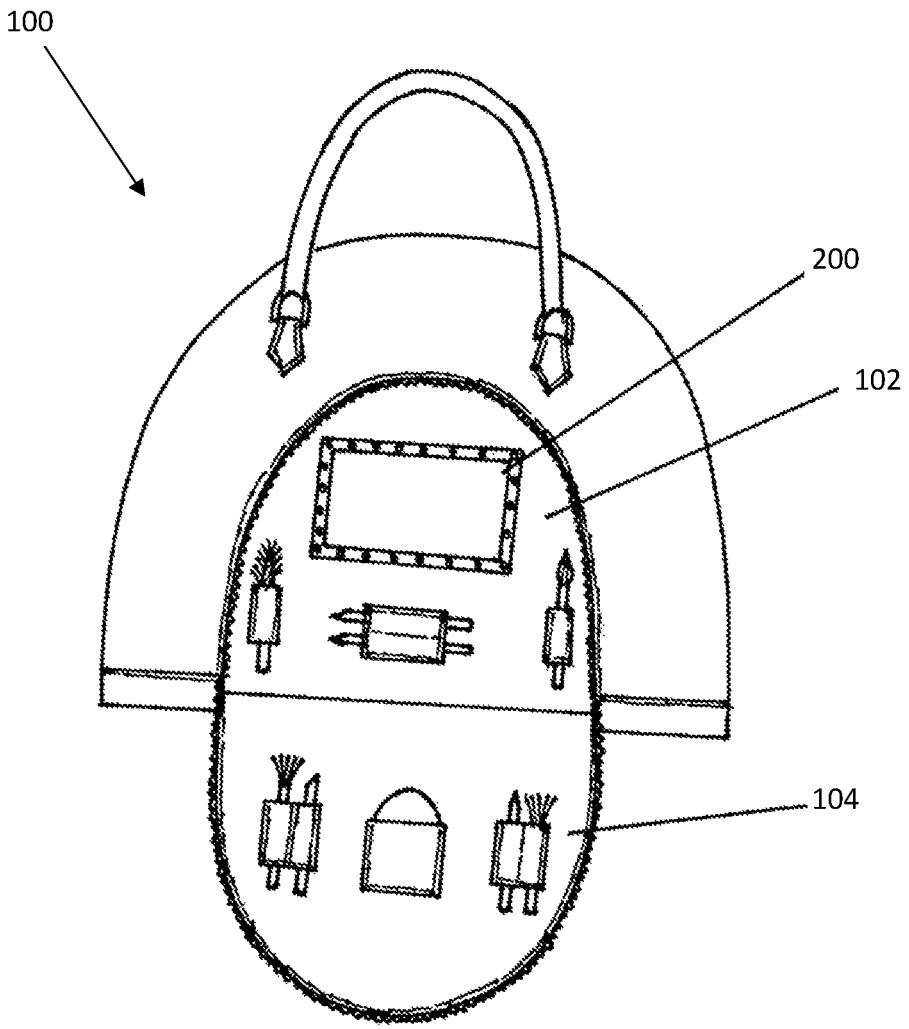
FIG. 6 Shows the front view of the Perfect Bag Plus satchel with the front pocket zipped open and the rectangular shaped lighted mirror device attached to the upper compartment. Shown also in this drawing is the is the zipped open pocket flap enclosed with makeup and cosmetic applicators.
Figure 7:
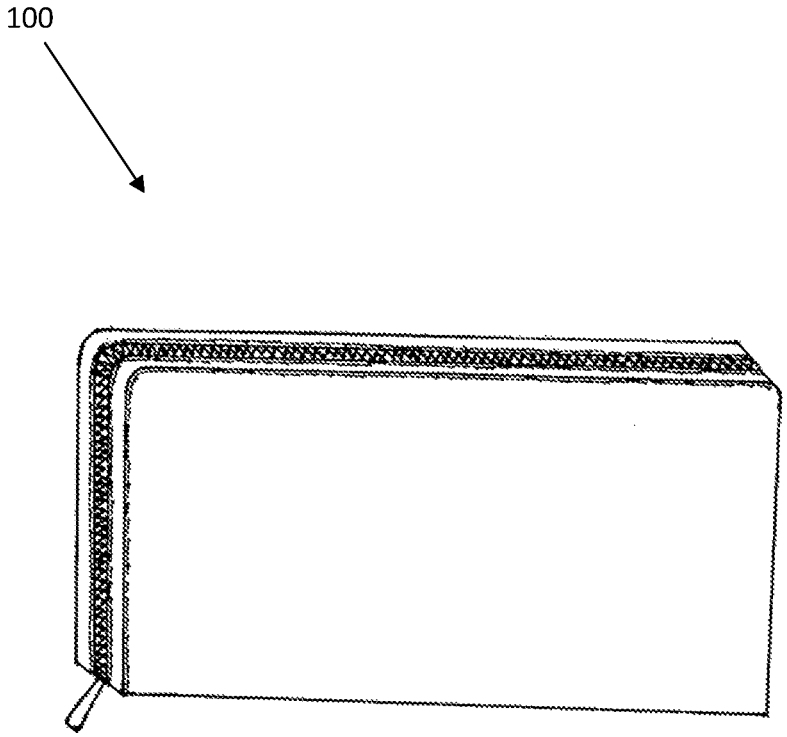
FIG. 7 Drawing shows front view of a Perfect Bag Plus clutch bag zipped closed.
Figure 8:
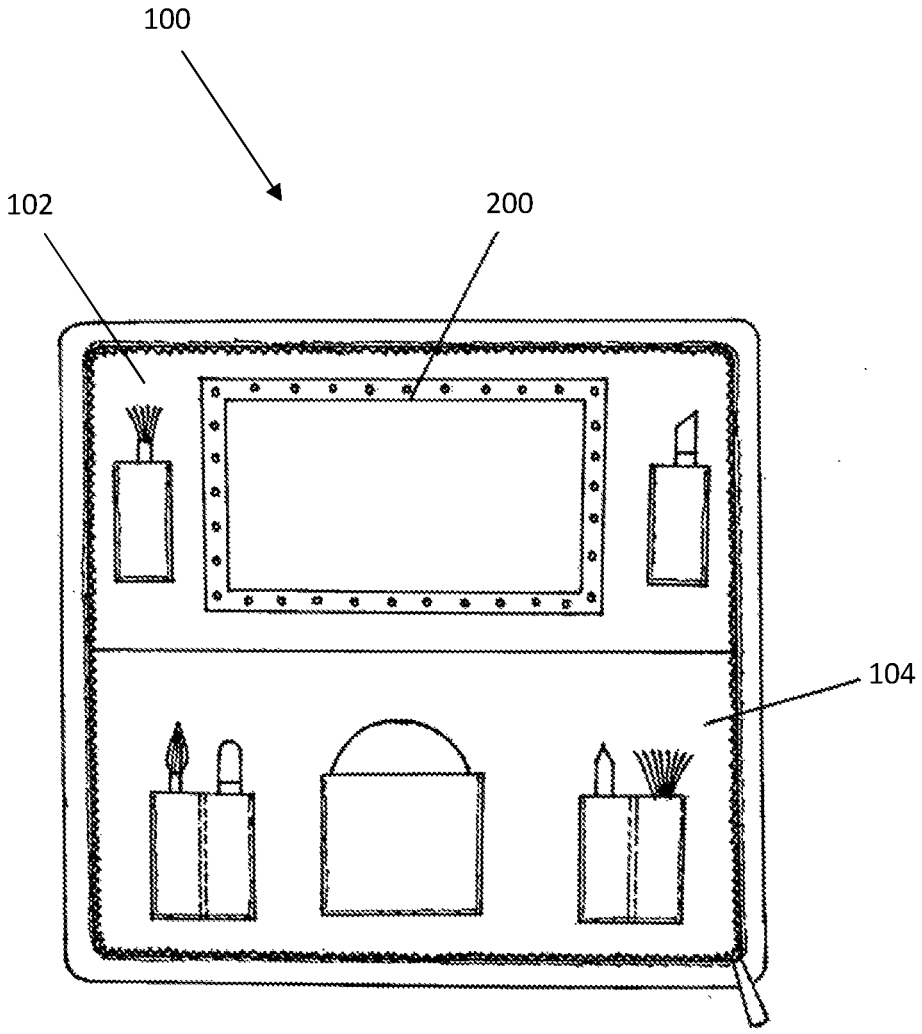
FIG. 8 This illustration shows front view of a Perfect Bag Plus clutch bag zipped open revealing a rectangular shaped lighted mirror device attached to the lining wall of the upper compartment. The lower compartment is enclosed with makeup and cosmetic applicators.
Figure 9:
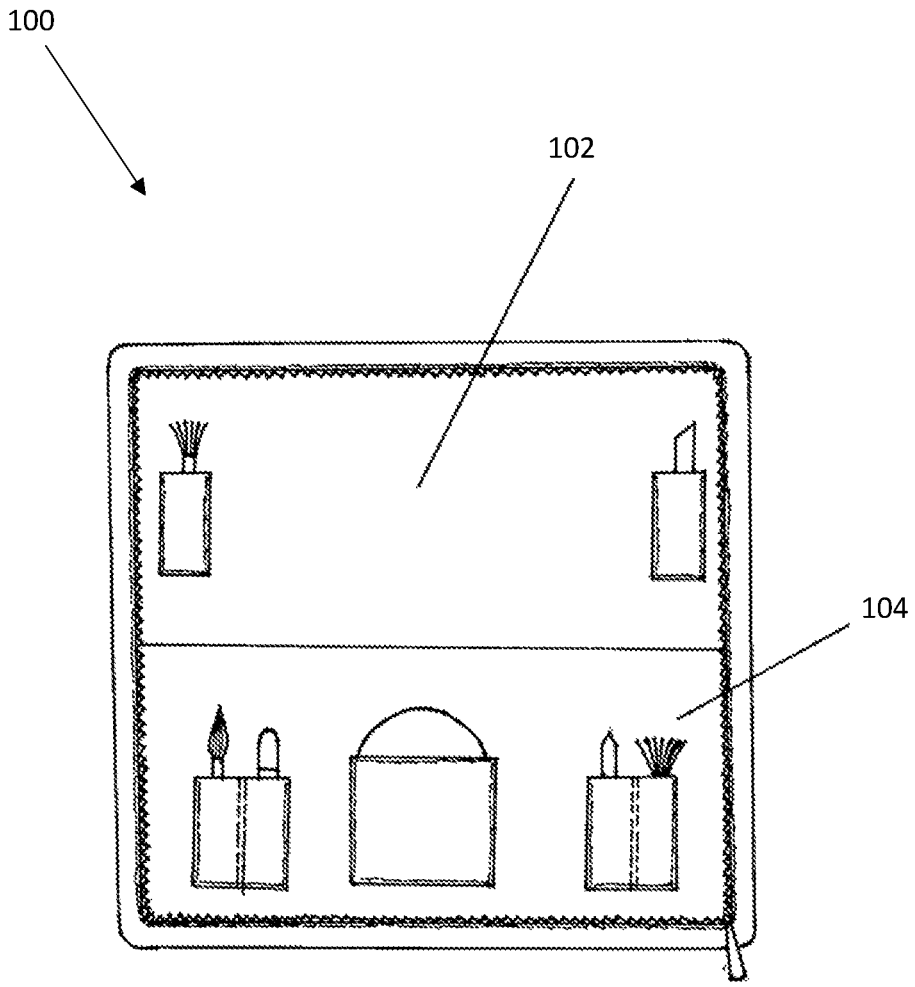
FIG. 9 Shows front view of Perfect Bag Plus clutch bag zipped open with the lighted mirror device removed from the upper compartment and makeup and cosmetic applicators enclosed in the lower compartment.
Figure 10:
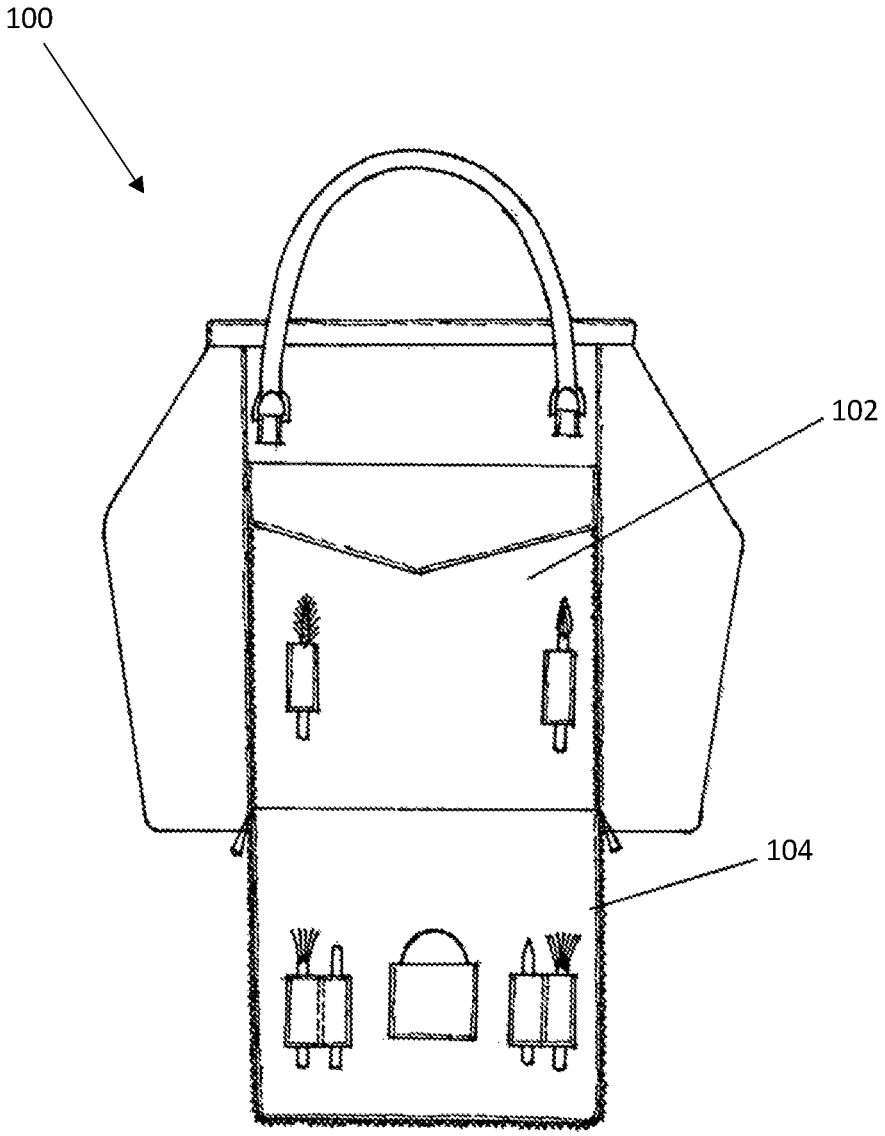
FIG. 10 shows the front view of the Perfect Bag Plus satchel style zipped open with the lighted mirror device removed. This drawing also shows the pocket flap enclosed with makeup and cosmetic applicators.
Figure 11:
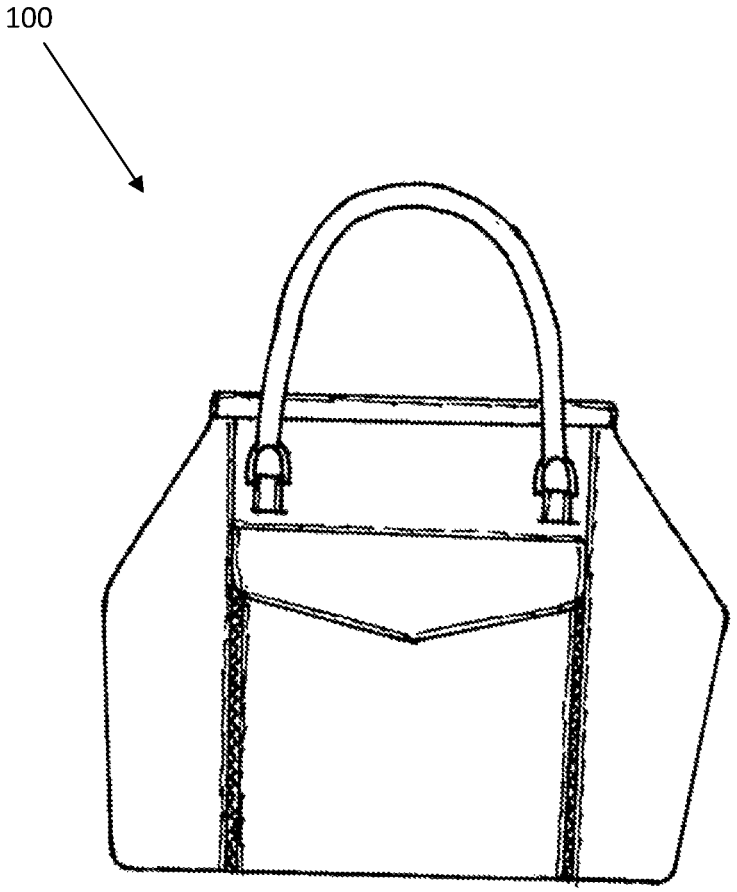
FIG. 11 shows front view of a zipped open Perfect Bag Plus with the front pocket zipped closed.
Figure 12:
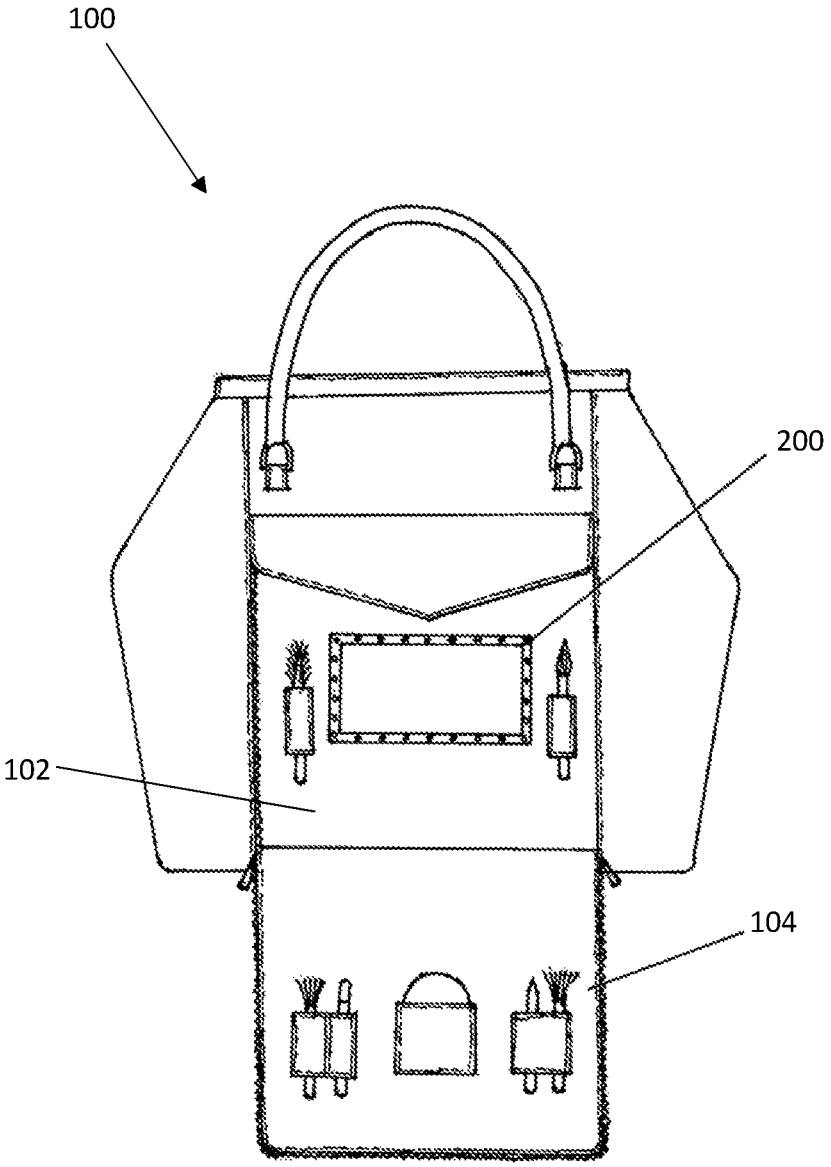
FIG. 12 this drawing shows the front view of a zipped open Perfect Bag Plus satchel with the lighted mirror device attached to the lining. Shown also is makeup and cosmetic applicators enclosed in the lining of the pocket flap.
Figure 13:
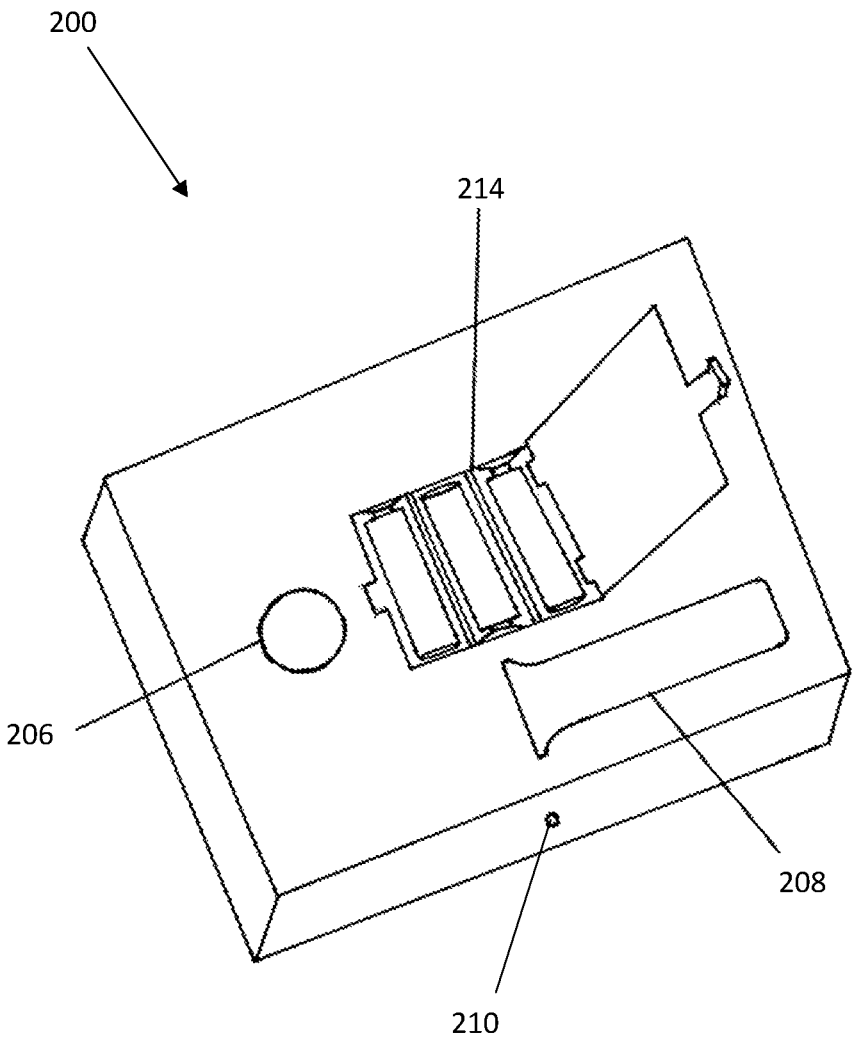
FIG. 13 is a three dimensional drawing, showing the back view and partial side views of the back of the lighted mirror device that operates with three double AA batteries. Also shown in this drawing is the opened battery compartment revealing batteries. Shown also is the left circular magnetic snap attached to the back of the lighted mirror device. The adjustable handle is shown folded horizontally on the back of the lighted mirror device.
Figure 14:
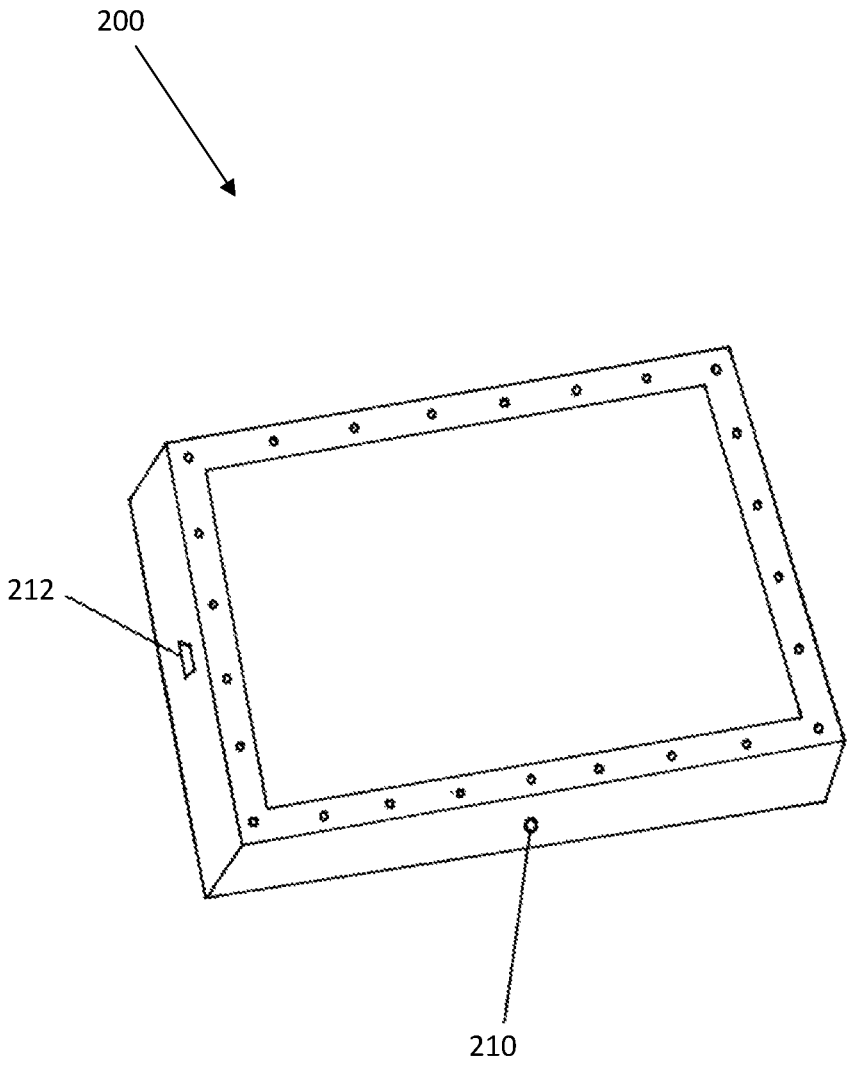
FIG. 14 is a three dimensional drawing showing the front view and left side view of the lighted mirror device detached from the Perfect Bag Plus with the usb input socket on the left side and the activation button centered on the bottom.
Figure 15:
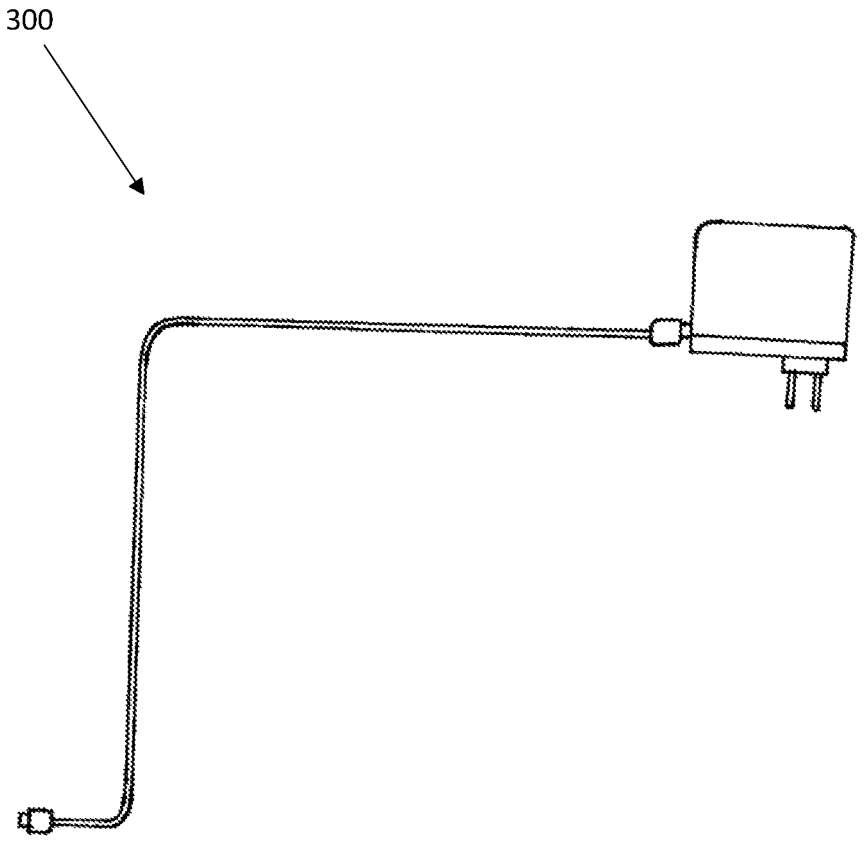
FIG. 15 this illustration shows the front view of the usb wall charger used to charge the cell battery when the lighted mirror device is designed to operate with a cell battery.
Figure 17:
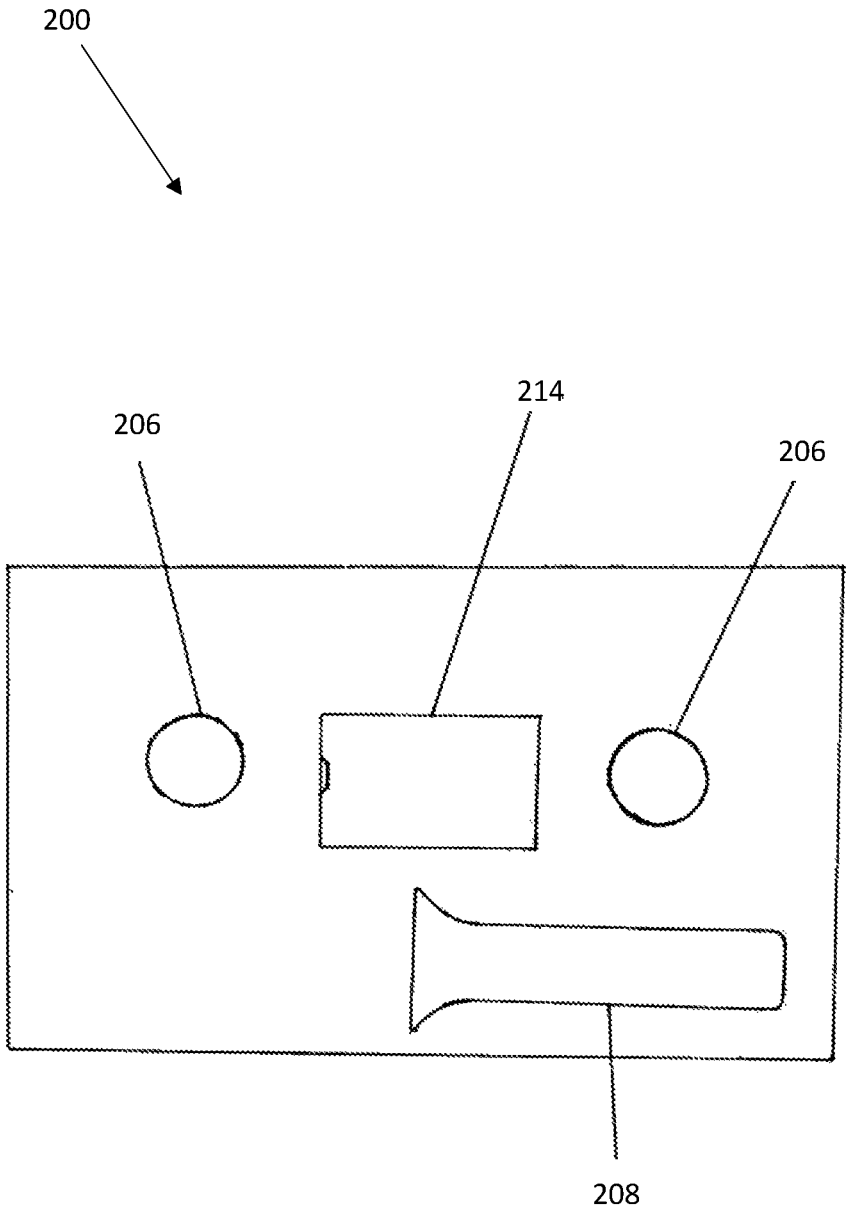
FIG. 17 shows back view of the lighted mirror device when the lighted mirror device is designed to operate with a cell battery and is recharged with a usb battery charger. The two small circles on the back are circular shaped magnetic snaps and the rectangle between the snaps is the cell battery compartment. Shown also is the adjustable handle folded horizontally on the back.
Figure 18:
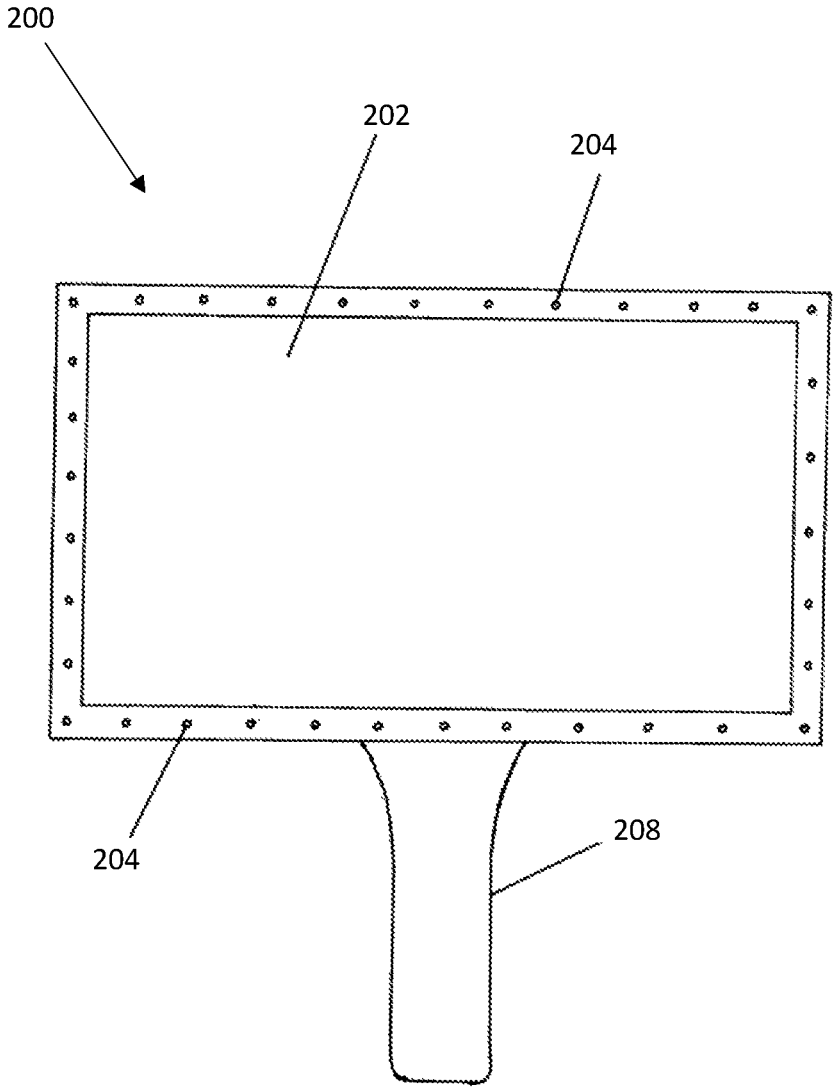
FIG. 18 drawing shows front view of the lighted mirror device with rectangular mirror surrounded with led lights and the adjustable handle turned vertical in the holding position.

When the lighted mirror device is activated the LED lights illuminate the mirror allowing clear, smooth and even application of makeup while providing optimum visibility to the consumer. The lighted mirror device 200 is activated with an on and off switch 210 located at the bottom of the lighted mirror device 210, see FIGS. 13 and 14. The lighted mirror device 200 can be designed to operate with three double AAA batteries or it can be manufactured to operate with a rechargeable cell battery that can be recharged with a usb wall charger 300 inserted into an input socket 212, see FIGS. 14 and 15. The batteries or cell batteries are located in a battery compartment 214, as seen in FIGS. 13 and 17. Located on the back of the lighted mirror device 200 is an adjustable handle 208, shown folded in horizontal position, see FIGS. 13 and 17. FIG. 18 shows front view of a rectangular shaped lighted mirror device 200 with the adjustable handle 208 in the vertical position.

What is claimed is:

1. A handbag comprising:

a zipper compartment configured for concealing makeup and cosmetic applicators and for being zipped open for access; and a lighted mirror detachable from a lining wall of the zipper compartment;

the lighted mirror being surrounded with LED lights and being attached to the lining wall with magnetic snaps.

2. A handbag comprising:

a zipper compartment located on an outer wall of a main holding space of the handbag, the zipper compartment being configured for concealing makeup and cosmetic applicators and for being zipped open for access without opening the main holding space of the handbag; and a mirror detachable from a lining wall of the zipper compartment, wherein the mirror comprises a plurality of LED lights surrounding a reflective surface of the mirror wherein the mirror is attached to a lining wall of the zipper compartment with magnetic snaps.

* * * * *